United States Patent [19]

Rausing

[11] Patent Number: 4,887,765

[45] Date of Patent: Dec. 19, 1989

[54] FLUID PACK AND PROCESS FOR THE PRODUCTION THEREOF

[75] Inventor: Hans Rausing, Wadhurst, England

[73] Assignee: Tetra Pak Finance & Trading S.A., Pully, Switzerland

[21] Appl. No.: 266,273

[22] Filed: Oct. 26, 1988

Related U.S. Application Data

[63] Continuation of Ser. No. 24,649, Mar. 11, 1987, abandoned.

[30] Foreign Application Priority Data

Mar. 11, 1986 [GB] United Kingdom ..... 8605911

[51] Int. Cl.[4] ..... B65D 5/70; B65D 5/72

[52] U.S. Cl. ..... 229/123.2; 220/269; 220/359; 229/125.14; 229/125.15; 229/125.17

[58] Field of Search ..... 229/123.2, 125.14, 125.15, 229/125.17; 206/621.7; 220/266, 269, 270, 359; 215/32

[56] References Cited

U.S. PATENT DOCUMENTS

| | | | |
|---|---|---|---|
| 2,347,686 | 5/1944 | Hothersall | 220/266 |
| 3,250,436 | 5/1966 | Kurtz | 229/125.15 |
| 3,322,297 | 5/1967 | Stolle et al. | 220/270 |
| 3,458,080 | 7/1969 | Laurizio | 220/270 |
| 3,900,155 | 8/1975 | Rausing et al. . | |
| 4,170,314 | 10/1979 | Weierman et al. | 220/359 |
| 4,244,491 | 1/1981 | Takahashi et al. | 229/125.14 |
| 4,312,450 | 1/1982 | Reil | 229/123.2 |
| 4,391,385 | 7/1983 | Rausing | 220/270 |
| 4,397,401 | 8/1983 | Ueno et al. | 220/359 |
| 4,669,640 | 6/1987 | Ando et al. | 220/266 |

FOREIGN PATENT DOCUMENTS

| | | | |
|---|---|---|---|
| 0141228 | 9/1984 | European Pat. Off. . | |
| 2243885 | 9/1972 | Fed. Rep. of Germany . | |
| 2751351 | 11/1977 | Fed. Rep. of Germany . | |
| 1432191 | 2/1966 | France | 220/270 |
| 589629 | 3/1959 | Italy | 220/270 |
| 1436929 | 5/1976 | United Kingdom . | |
| 1461026 | 1/1977 | United Kingdom | 220/270 |
| 2010214 | 6/1979 | United Kingdom . | |

*Primary Examiner*—Gary Elkins

*Attorney, Agent, or Firm*—Biebel, French & Nauman

[57] ABSTRACT

A fluid pack made of plastics-coated paper in which the side walls (2) and/or the cover (1) are connected together by way of fold edges (9) and provided in the cover (1) is an opening device (7) having a cover strip (10) which sealingly engages over a stamped-out hole (6).

So that the opening device (7) can be produced in an operationally reliable and economic fashion even in a high-capacity machine, the cover strip (10) is injected plastics material and the edge regions (13) thereof cover over the edge portions (14) of the stamped-out hole (6) on both inner and outer sides of the hole.

5 Claims, 2 Drawing Sheets

FLUID PACK AND PROCESS FOR THE PRODUCTION THEREOF

Figure 1:
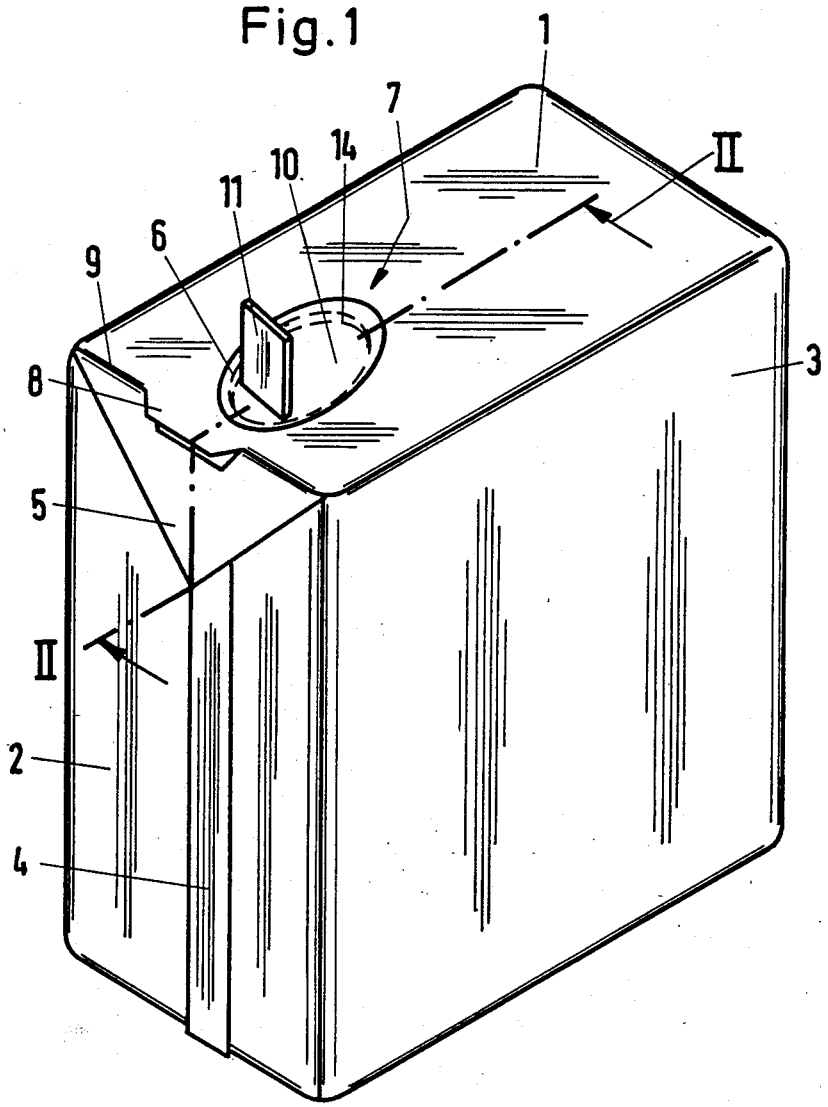

This is a continuation of Ser. Nos. 024,649 filed Mar. 11, 1987, now abandoned.

This invention relates to a fluid pack made of plastics-coated carrier material of paper or the like, in which side walls and/or a cover and/or a bottom are connected together by weld seams and/or fold edges and in which an opening means is provided in the cover or in one of the side walls, which opening means has a cover strip which sealingly engages over a stamped-out hole.

Among the many known fluid packs of this kind, are parallepipedic or square packs which are used for milk and in which the cover and the bottom are connected to the side walls by fold lines and have double-ply triangular panels communicating with the interior of the pack, on both sides. In other packs of this kind, also for fluids or flowing substances, many proposals for opening means have been published. Such opening means must be easy to handle from the point of view of the final consumer, they must remain fluid-tight until they are first opened, even in relation to a filled pack which is subjected to a heavy loading, and as far as possible they should be reclosable. In order to produce such opening means, the manufacturers of such packs have developed increasingly complex equipment, machines and process.

Thus it is known for example for a hole to be produced by stamping or punching, in a machine for producing and filling a fluid pack, in order to provide an opening means, with the hole being welded on both sides to a cover strip. Either, one of the cover strips is to be used as a tear-open strip, or additional pull tags are sealed in position on the pack in order to initiate the operation of opening the pack, that is to say, breaking the cover strip open over the punched or stamped hole of the opening means.

It has been found in the past that, although such opening means fulfil the requirements of the final consumer, they do however give rise to considerable costs in manufacture because it is necessary to use either expensive packaging machines or additional materials.

There is thus a need for a generally improved fluid pack in which an opening means can also be produced in an operationally reliable and economic fashion in a high-capacity machine (large number of items per unit of time).

According to the present invention is provided a fluid pack made of plastics-coated carrier material of paper or the like, in which side walls and/or a cover and/or a bottom are connected together by weld seams and/or fold edges, and in which an opening means is provided in the cover or in one of the side walls, which opening means has a cover strip which sealingly engages over a stamped-out hole, wherein the cover strip is injected plastics material with edge regions which cover over edge portions of the stamped-out hole on both inner and outer sides of the hole.

Thus a fluid pack of the invention has only a single cover strip which engages around the stamped-out hole on both sides thereof, that is to say both on the outer edges and also on the inner edges thereof. The fact that the hole is punched or stamped out means that formed at least at the edge faces of the hole are surfaces which are outwardly exposed without a covering of plastics material. If these edges are not covered by plastics material, then fluid filling material could penetrate into the exposed web of paper, could cause it to swell and could ruin the pack in the region of the opening means. That was also the reason why known fluid packs had both a cover strip on the inside and also a cover strip on the outside. That double security effect is achieved in a simpler fashion, in a pack of the present invention.

The fact of injecting the plastics material means that a cover strip of a three-dimensional configuration is formed, which connects to the edge portions of the stamped-out hole on the outside and inside thereof and which therefore adheres firmly over the stamped hole.

It is also advantageous in accordance with the invention if a pull tag is injection moulded integrally on the cover strip. By virtue of using the injection moulding process for forming the cover strip, it it possible for a pull tag to be injection moulded in one piece. Many pull tags which are formed in one piece with a plug or stopper are known in relation to opening means on containers. By virtue of using that known injection moulding art and the known shapes, it is also possible to provide pull tags of any desired appropriate configuration for the fluid packs according to the invention. The same also applies in regard to the location at which they are mounted, in relation to the stamped-out hole. Preferably the pull tag will be disposed more towards the edge of the hole on the cover strip, so that when the pull tag is pulled up, the tearing operation begins in the region of the edge of the hole and a larger opening can be exposed by tearing the pack open to the opposite side. The pull tag itself may also be provided with a triangular tearing tip portion at which the tearing effect begins so that a larger hole is formed in the cover strip by pulling the pull tag up.

It is also desirable in accordance with the invention if the cover strip is a thin foil in the region of the stamped-out hole and if the pull tag is in the form of a flat panel portion which stands up perpendicularly out of the cover strip. The above-mentioned conditions in regard to the sealing effect and logical as well as easy openability of the cover strip are also achieved when the cover strip is formed simply as a thin strip, thereby saving material, with the strip being for example from 0.3 to 2 mm, preferably from 1 to 1.5 mm, in thickness. In the edge regions, the cover strip can be made thicker by using a suitable shape or mould so that the edges of the stamped out hole are covered on the inside and outside by strong round limb portions.

If the pull tag is of a substantially flat, up-standing configuration, in the above-described manner, it is possible to use a particularly simple injection tool in which the lower half of the mould is also in one piece, like the upper half of the mould, and the moulding is removed from the mould in the direction of the pull tag. If the pull tag has other portions which extend parallel to the main surface of the cover strip, the outer mould in turn would have to be divided again. When using the above-indicated feature of the invention, relating to the pull tag of a flat configuration, it is even possible to eliminate the need to divide the one half of the injection moulding tool into two.

The invention also relates to a process for the production of a fluid pack made of plastics-coated carrier material of paper or the like, in which side walls and/or a cover and/or a bottom are connected together by weld seams and/or fold edge and in which provided in the cover or in one of the side walls is an opening means having a cover strip which engages sealingly over a stamped-out hole, wherein a coated paper web, lying flat, is drawn from a supply roll, formed into a tube, filled with fluid, divided off by transverse sealing seams, separated and fomed into packs.

Many different forms of such processes for the production of fluid packs at a high level of output are known. For example, it is possible to produce tetrahedral, parallelepipedic or tubular packs in this way. When the appropriate opening means is fitted, however, the difficulties which have already been described above occur, and they could only be overcome by using additional materials or complicated production machinery.

There is thus a need for simplification of the production of a fluid pack such that in spite of a high output (large number of items per unit of time), it is possible to produce satisfactorily sealed packs, with pouring means which are easy to open, in an economical fashion.

According to another aspect of the present invention there is provided a process for the production of a fluid pack made of plastics-coated carrier material of paper or the like, in which side walls and/or a cover and/or a bottom are connected together by weld seams and/or fold edges and in which provided in the cover or in one of the side walls is an opening means having a cover strip which engages sealingly over a stamped-out hole, wherein a coated paper web, lying flat, is drawn from a supply roll, formed into a tube, filled with fluid, divided off by transverse sealing seams, separated and formed into packs, with the hole for the opening means being stamped into the paper web in register relationship with printing and/or fold line pattern, prior to or after being drawn from the supply roll, and with the plastics material cover strip being fluid-tightly injected into the stamped-out hole shortly before the operation of transforming the flat web into the tube, so that edge regions of the cover strip fuse with the plastics coating on both inner and outer surfaces of the paper web.

From the point of view of the paper manufacturer for such fluid packs, it is an easy operation to stamp or punch a hole for the opening means into a coated paper web, and the removal of material at that point does not give rise to any problems in regard to winding it on the supply roll. Although it would also be an easy matter for the paper manufacturer to inject a cover strip in relation to the hole for the opening means, by using a suitable injection machine, it is applied so considerably that when a web of paper has been processed in that fashion, it could no longer be wound onto a supply roll. On the other hand, when using conventional packaging machines, a paper web is employed, which is fluid-tight over its entire surface. There are at prsent no packaging mahines which inject plastics closure means into a previously stamped-out hole in a web of paper.

The invention is the first to provide for the production of an opening means with the necessary and advantageous conditions relating to sealed nature, easy and logical openability and economical production of an opening means, wherein operation can be carried out in accordance with the process of the invention on a conventional paper web which is drawn from a supply roll.

Figure 2:
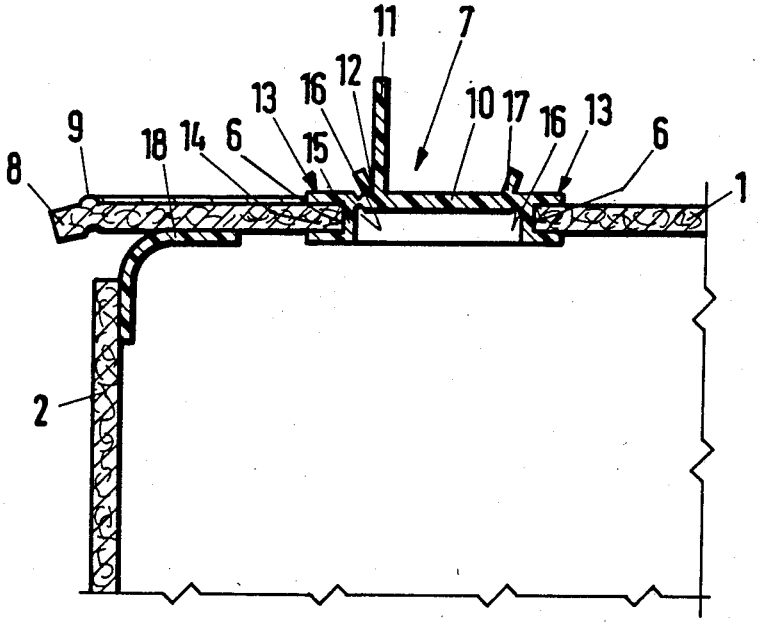

For a better understanding of the present invention, and to show how the same may be carried into effect, reference will now be made by way of example, to the accompanyig drawings, in which:

FIG. 1 is a perspective view of a parallelepipedic fluid pack having an opening means in accordance with the invention, and FIG. 2 is a diagrammatic broken-away view in section taken along line II—II in FIG. 1.

The fluid pack described and illustrated herein is a commercially available milk or fruit juice pack of parallelepipedic shape. The material of the pack is paper which is thinly coated with plastics material on both sides and which forms both side walls 2 nd 3 and also a bottom and a cover 1, as shown in FIG. 1. The side walls are produced by the formation of a tube which is closed along a longitudinal sealing seam 4. In the illustrated embodiment, no transverse sealing seam is shown on the cover side. The transverse sealing seam is disposed in other wall portions of the pack which are not shown in the drawings. The cover 1 and the bottom are provided with folded-over triangular panels 5 which are formed integrally with the side walls 2 and 3 and which communicate with the interior of the pack.

Really only the opening means which is generally denoted by reference number 7 and the method of forming it are of interest in regard to the present invention, the opening means 7 being described in greater detail hereinafter and being located in the illustrated embodiment in the wall panel of the cover 1 beside a front fold edge 9. Shown at the front in the direction of pouring in FIG. 1 is also a pouring strip 8 which is intended to make it easier for the jet of liquid filling material which is poured out of the pack to break away from the edge of the pack.

The opening means 7 is formed by punching or stamping out the hole 6 which is closed by cover strip 10 of injected plastics material. A pull tag or flap 11 in the form of a flat panel portion projects substantially perpendicularly from the cover strip 10. The front fitting edge of the pull tag 11 which is shown at 12 in FIG. 2 is disposed at an off-centre position. The pull tag 11 on the opening means 7 is disposed eccentrically with respect to the hole 6. However the edge 12 may also be displaced towards the oppositely disposed side in order in any case to ensure that a larger hole is torn open when the fluid pack is opened.

FIG. 2 in particular shows the edge regions 13 of the cover strip 10 which, like double flange configurations, cover over the edge portions 14 of the hole 6 both on the inside and on the outside of the pack. FIG. 2 also shows an annular leg portion 15 of the cover strip 10. This leg portion 15 connects the two flange-like edge regions 13 of the cover strip 10 and covers over the edge face of the stamped-out hole which after stamping out is exposed outwardly without any plastics coating, in such a way that no fluid can penetrate into the paper, either from inside or from outside the pack.

Consideration of FIG. 2 also makes it possible to form a good idea of a suitable injection mould which is not shown but in which the inner or lower mould portion is to be considered as being arranged below the cover 1 while the upper portion is to be considered as being in one piece above the boundary or limit of the web or material forming the cover 1. The closely hatched region which represents the cover strip 10 would then represent the hollow mould into which the plastics material is injected. It will be appreciated therefore that the process for the production of the opening means of any fluid pack is effected rapidly and economically because, besides a small amount of plastics material, it is possible to use no further materials and in addition to employ a simple production machine.

The form of the packs which can be provided with a novel opening means of this kind may obviously differ from the parallelepipedic shape shown here in the drawings. Tubular or box-like packs are known in which a web or paper is also first perforated and which has the cover strip injected thereon shortly before the pack configuration is made up or a tube is formed.

FIG. 2 also shows two tear lines 16 which, in a preferred emboidment, may also blend into each other as an endless single line, in the form of a circle or oval. In FIG. 2 the left-hand weakening or tear line 16 is arranged directly beside the tag 11 so that the pack is opened when the pull tag 11 is pulled up. The circular or oval portion of the cover strip 10 is provided within the tear lines 16 with a re-closure edge which is indicated at 17 in FIG. 2. In that way the part of the opening means 7 which is torn out can be pushed into the opening again, until a condition of contact of the reclosure edge 17 is reached, and retained or latched in the opening.

An inner cover strip 18 fluid-tightly seals off the pack, in spite of the pouring edge 8.

With the process of the invention for producing the fluid pack, independently of an injection machine and the liquid pack production machine, a hole can be stamped out using known procedures with a high degree of register accuracy in relation to the printing and/or the pattern of the fold lines on the web. This provides a paper web which is coated with plastics material on both sides and which, although it has a hole, that hole is disposed precisely at the desired location so that it is well suited for advertising, for instructions relating to opening the pack, and in relation to the general image of the pack. Such a pre-treated paper web which is provided with a hole is now passed to the packaging machine, upstream of which, prior to the tube forming devices, is an injection installation. Printed matter, edge, fold lines or even the stamped-out hole may precisely set the position of the web relative to the injection machine in such a way that a plastics foil can be injected as the cover strip at precisely the right position in the region of the stamped-out hole. By virtue of the hot liquid plastics material also being pressed onto the edges around the stamped-out hole, the surface layers to be found at that location are plastics-coated both on the outside and on the inside so that the edge regions of the injection-moulded cover strip fuse to the above-mentioned plastics coating. That provides for firm anchoring and fluid-tight joining of the cover strip to the wall portions aound the hole. In addition the injection means may be of a very simple configuration in the above-mentioned manner, in particular when the pull tag is arranged to stand up perpendicularly out of the cover strip.

After leaving that injection machine for the cover strip, the stamped-out hole is completely fluid-tightly closed and the web can then be converted into a tubular form in the usual manner so that further processing involving filling, transverse sealing, separating and shaping of the finished pack can be carried out as with conventional machines. The injection-moulded cover strip does not interfere with that production process.

I claim:

1. A fluid pack comprising:

a pack body formed from a sheet material in the form of paper coated with plastic on the inner and outer surfaces thereof and defining at least one side wall, a bottom and a cover, said side wall, said bottom and said cover being interconnected and having an inner surface and an outer surface;

said pack body defining a hole therethrough, said hole defining an edge around the periphery thereof, opening means for normally closing said hole in said pack body while permitting opening thereof, said opening means including a cover strip formed from an injected plastic material;

said cover strip being molded in situ of plastic material having annular, integral edge engagement means formed about the periphery of said cover strip and sealingly surrounding said edge and extending onto both said inner and said outer surfaces adjacent said edge around the complete periphery of said hole and fused with the plastic coating of said sheet material at said inner and outer surfaces adjacent said edge, and a panel portion of said cover strip defined as an area radially within the boundary of said edge engagement means and having at least one marginal edge thereof defined by a tear line, said panel portion being at least partially separable from the remainder of said strip by separation along said tear line.

2. A fluid pack as defined in claim 1, wherein said hole is defined through said cover of said pack body.

3. A fluid pack as defined in claim 1, wherein said opening means further includes a pull tag connected to said panel portions and integrally formed with said cover strip.

4. A fluid pack as defined in claim 3, wherein said cover strip is in the form of a relatively thin foil with respect to said pack body, and wherein said pull tag extends upwardly substantially perpendicularly from said cover strip.

5. A fluid pack as defined in claim 1 wherein said cover strip is disposed for closing said hole substantially in the same plane as said hole.

* * * * *